US011248393B2

(12) United States Patent
Xiao et al.

(10) Patent No.: US 11,248,393 B2
(45) Date of Patent: Feb. 15, 2022

(54) LATCH BOLT BUFFER STRUCTURE FOR LOCK BODY

(71) Applicant: Guangdong Mingmen Locks Industry Co., Ltd., Guangdong (CN)

(72) Inventors: Qian Xiao, Guangdong (CN); Guangrui Ran, Guangdong (CN)

(73) Assignee: Guangdong Mingmen Locks Industry Co., Ltd.

( * ) Notice: Subject to any disclaimer, the term of this patent is extended or adjusted under 35 U.S.C. 154(b) by 547 days.

(21) Appl. No.: 16/329,100

(22) PCT Filed: Feb. 13, 2018

(86) PCT No.: PCT/CN2018/076706
§ 371 (c)(1),
(2) Date: Feb. 27, 2019

(87) PCT Pub. No.: WO2019/015319
PCT Pub. Date: Jan. 24, 2019

(65) Prior Publication Data

US 2019/0226235 A1 Jul. 25, 2019

(30) Foreign Application Priority Data

Jul. 19, 2017 (CN) ..... 201710587941.3

(51) Int. Cl.
*E05B 15/10* (2006.01)
*E05B 17/00* (2006.01)

(52) U.S. Cl.
CPC ..... *E05B 15/10* (2013.01); *E05B 17/0041* (2013.01); *E05B 17/0045* (2013.01)

(58) Field of Classification Search
CPC ..... E05B 15/10; E05B 15/102; E05B 15/108; E05B 17/0041; E05B 17/0045;
(Continued)

(56) References Cited

U.S. PATENT DOCUMENTS 3,673,830 A * 7/1972 Billino ..... E05B 59/00 70/352
2016/0326771 A1 11/2016 Qi

FOREIGN PATENT DOCUMENTS

CN 203879118 U 10/2014
CN 106193805 A * 12/2016
(Continued)

OTHER PUBLICATIONS

International Search Report PCT/CN2018/076706, dated Apr. 24, 2018.

(Continued)

*Primary Examiner* — Christine M Mills
*Assistant Examiner* — Christopher F Callahan
(74) *Attorney, Agent, or Firm* — Lerner, David, Littenberg, Krumholz & Mentlik, LLP

(57) ABSTRACT

A latch bolt buffer structure is disclosed for lock body, including outer lining board for lock body, latch bolt assembly, damper, connecting rod, latch bolt poking mechanism, dead bolt mechanism, box cover and box bottom assembly for lock body. Latch bolt assembly includes latch bolt, friction bolt, pull rod, spring, limiting silencing ring, and slider. The box bottom assembly includes an inner lining board for the lock body, a silencing block for the dead bolt, a silencing block for the latch bolt, a box bottom, a positioning plate, a spring, a fixing nail and a damper. Manufacturing parts made of sound-absorbent plastic material is adopted to replace metal parts, or separating metal parts by sound-absorbent plastic material is adopted to reduce noise generated by friction. At the same time, the damper buffer function is used to reduce sound generated by parts collision when lock body is working.

3 Claims, 6 Drawing Sheets

(58) Field of Classification Search
CPC ..... E05B 63/14; E05B 63/146; Y10S 292/51; Y10S 292/53; Y10S 292/54; Y10S 292/56; Y10S 292/57; Y10S 292/73
See application file for complete search history.

(56) References Cited

FOREIGN PATENT DOCUMENTS

| | | | | | |
|---|---|---|---|---|---|
| CN | 106639670 | A | | 5/2017 | |
| CN | 107288421 | A | | 10/2017 | |
| DE | 102005039956 | A1 | * | 3/2007 | ..... E05C 9/023 |
| DE | 202007016556 | U1 | | 4/2009 | |
| EP | 0610542 | A2 | * | 8/1994 | ..... E05B 63/14 |
| EP | 2385196 | A2 | * | 11/2011 | ..... E05B 47/0669 |
| WO | 2016062158 | A1 | | 4/2016 | |

OTHER PUBLICATIONS

Extended European Search Report including Written Opinion for EP18834327.1 dated Mar. 25, 2020; 6 pages.

* cited by examiner

LATCH BOLT BUFFER STRUCTURE FOR LOCK BODY

CROSS REFERENCE TO RELATED APPLICATIONS

The present application is a national phase entry under 35 U.S.C. § 371 of International Application No. PCT/CN2018/076706, filed Feb. 13, 2018, which claims priority from Chinese Patent Application No. 201710587941.3 filed Jul. 19, 2017, all of which are hereby incorporated herein by reference.

TECHNICAL FILED

The present disclosure relates to the field of door locks for household use, particularly to a lock body, and more particularly to a silent lock body with less noise.

BACKGROUND

At present, members of the door locks used in the household field are usually made of metal material. Thus, when the door is opened or closed, noise will be generated due to impact or friction between the components. With the improvement of people's consumption level, in an office space or a household occasion, it is desired to reduce this kind of noise as much as possible. Many inventors have proposed corresponding solutions from different technical perspectives. A common solution involves the bolt that is most prone to impact, and it reduces the impact of the bolt directly or makes improvements to the parts in contact with the bolt. The solution has a certain positive effect in reducing the noise generated during the door is closed. However, the effect is not very obvious. For example, a rubber ring is mounted on a pull rod and damping oil is added to eliminate the sound generated by collision. The problem is that the rubber ring tends to age and adhere to the pull rod, so that the bolt cannot extend (or retract). Alternatively, the damping oil will condense in a cold environment, so that the resistance will increase, and the latch bolt will become dull when it extends (or retracts).

SUMMARY

In view of the deficiencies of the prior art, the technical problem to be solved by the present disclosure is to reduce the sound caused by the impact between the internal components of the door lock, and to provide a latch bolt buffer structure for a silent lock body that is high safety performance and good stability, and suitable for different occasions and environments.

The present disclosure is achieved by the following technical solutions.

A latch bolt buffer structure for a lock body is provided, comprising an outer lining board for the lock body, a box cover for the lock body, a box bottom assembly for the lock body, a latch bolt assembly, a damper, a connecting rod, a dead bolt mechanism and a latch bolt poking mechanism. The box bottom assembly for the lock body is formed by welding a box bottom and an inner lining board for the lock body, the inner lining board for the lock body is provided with a latch bolt hole and a dead bolt hole, the side edge of the box bottom is provided with a latching position for a silencing block of the latch bolt and a latching position for a silencing block of the dead bolt, and a plurality of studs, a plurality of limiting columns, a positioning plate, a fixing nail, a reversing plate and a torsion spring are fixed at corresponding positions on a bottom plate surface of the box bottom. The positioning plate is provided with a U-shaped groove.

The latch bolt assembly comprises a latch bolt, a friction bolt, a pull rod, a spring, a limiting silencing ring and a slider. The middle of the latch bolt is provided with a silencing friction bolt. The pull rod is fixed on the rear end of the latch bolt, the spring and the limiting silencing ring are mounted in the pull rod, and a positioning ring is provided on the tail of the pull rod and embedded in the positioning groove on the slider. The limiting silencing ring is clamped in the U-shaped groove on the positioning plate.

The latch bolt poking mechanism comprises a latch bolt poking member, a poking piece, an upper silencing pad, and a lower silencing pad.

The latch bolt assembly is connected to the damper by the connecting rod, the slider is provided with a connecting rod pivot, the damper is provided with a damping flat shaft, one end of the pull rod is provided with a movable pivot hole pivotally connected to the connecting rod pivot, and another end of the pull rod is provided with an embedded flat groove in which the damping flat shaft is embedded. When the latch bolt extends (or retracts), the slider slides together with the pull rod, the connecting rod pivot slides in the movable pivot hole and drives the end of the movable pivot hole of the connecting rod to swing. The connecting rod transmits the swing moment to the damper through the embedded flat groove and the damper flat shaft, and the damper generates rotational resistance to slow down the swing moment, thereby achieving the buffer for the extension (or retraction) of the latch bolt.

The buffer for the extension (or retraction) of the latch bolt can also be achieved by changing the structure of both ends of the connecting rod. One end of the connecting rod is provided with a pivot hole pivotally connected to the connecting rod pivot, another end of the connecting rod is provided with a sliding groove in which the damping flat shaft is embedded, and the damping flat shaft is slidable in the sliding groove. When the latch bolt extends (or retracts), the slider slides together with the pull rod, and at the same time drives the end of the pivot hole of the connecting rod to swing, the connecting rod transmits the swing moment to the damper through the sliding groove and the damper flat shaft, and the damper generates rotational resistance to slow down the swing moment, thereby achieving the buffer for the extension (or retraction) of the latch bolt.

1—outer lining board for the lock body;

2—box bottom assembly: 21—inner lining board for the lock body, 22—silencing block of the dead bolt, 23—stud, 24—fixing nail, 25—torsion spring, 26—limiting column, 27—position plate, 271—U-shaped groove, 28—reversing plate, and 29—silencing block of the latch bolt;

3—dead bolt assembly: 31—dead bolt, 32—driver piece, 33—dead bolt plate, and 34—dead bolt poking member;

4—latch bolt poking mechanism: 41—poking lower silencing pad, 42—latch bolt poking member, 43—poking piece, and 44—poking upper silencing pad;

5—latch bolt assembly: 51—friction bolt, 52—resilient pin A, 53—latch bolt, 54—spring, 55—limiting silencing ring, 56—pull rod, 561—positioning ring, 57—slider, 571—positioning groove, 572—connecting rod pivot, and 58—resilient pin B;

6—connecting rod: 61—movable pivot hole, 610—pivot hole, 62—embedded flat groove, and 620—sliding groove;

7—latch bolt damper: 71—damping flat shaft;

8—box cover for the lock body; and

91—sealing member A, 92—sealing member B, and 93—sealing member C.

DETAILED DESCRIPTION

Figure 1:
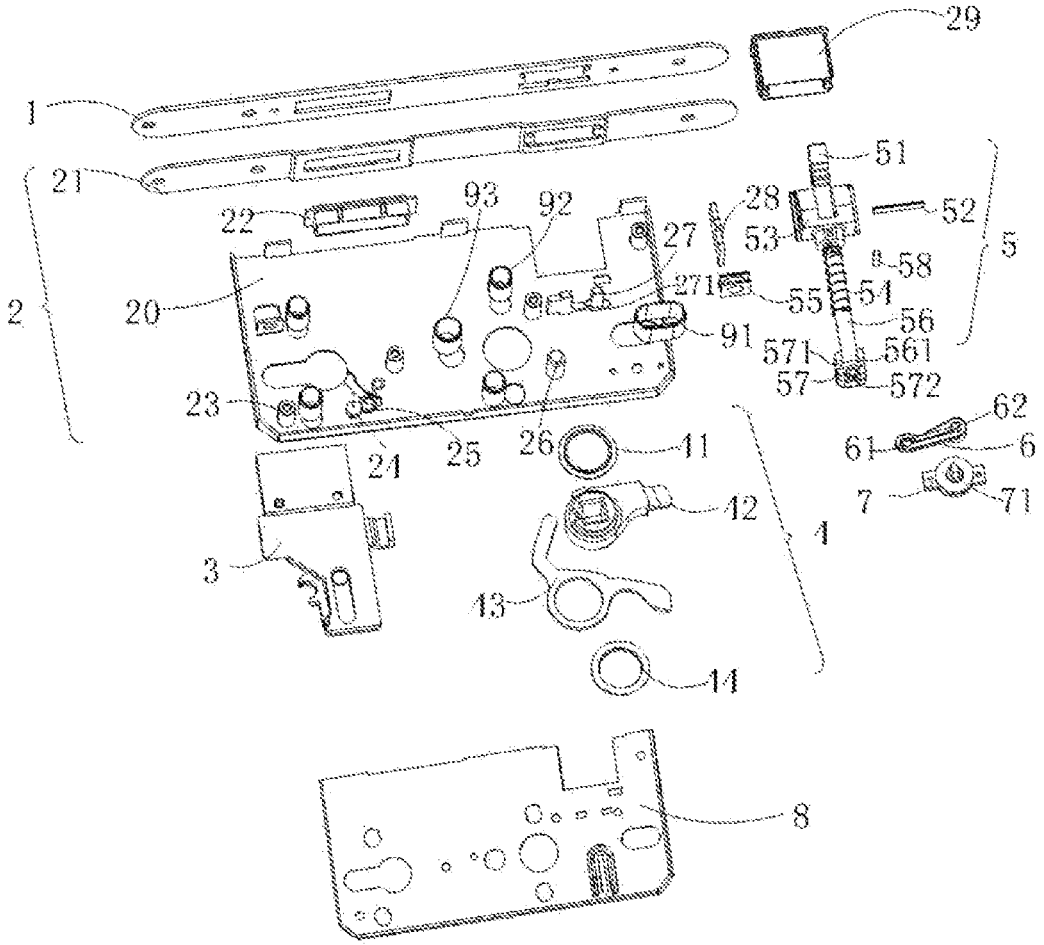
FIG. 1 is a schematic diagram of the present disclosure in an exploded state.
Figure 2:
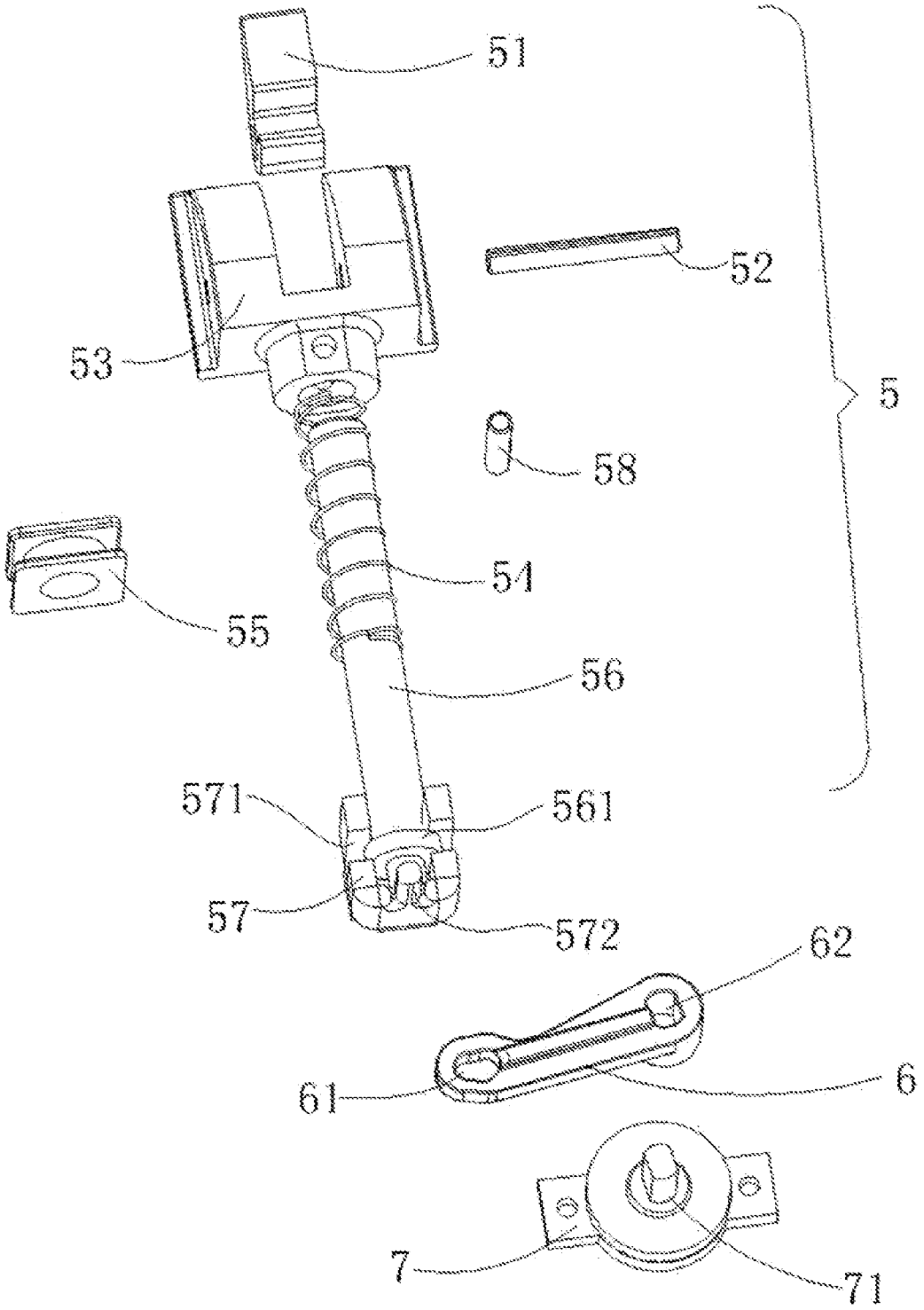
FIG. 2 is an enlarged schematic diagram illustrating the latch bolt and the buffer member thereof of FIG. 1.

As shown in FIG. 1 and FIG. 2, the present disclosure relates to a latch bolt buffer structure for a lock body, which includes an outer lining board 1 for the lock body, a box bottom assembly 2 for the lock body, a dead bolt mechanism 3, a latch bolt poking mechanism 4, a latch bolt assembly 5, a connecting rod 6, a damper 7, a box cover 8 for the lock body, a sealing member A 91, a sealing member B 92, and a sealing member C 93. The box bottom assembly 2 for the lock body is formed by welding a box bottom 20 and an inner lining board 21 for the lock body, a plurality of studs 23, a plurality of limiting columns 26, a positioning plate 27, a fixing nail 24, a reversing plate 28 and a torsion spring 25 are fixed at corresponding positions on a bottom plate surface of the box bottom. The positioning plate 27 is provided with a U-shaped groove 271.

The latch bolt poking mechanism 4 includes a latch bolt poking member 42, a poking piece 43, an upper silencing pad 44, and a lower silencing pad 41.

The latch bolt assembly 5 includes a friction bolt 51, a resilient pin A 52, a latch bolt 53, a spring 54, a limiting silencing ring 55, a pull rod 56, a slider 57, and a resilient pin B 58. The middle of the latch bolt 53 is provided with the silencing friction bolt 51. The pull rod 56 is fixed on the rear end of the latch bolt 53. The spring 54 and the limiting silencing ring 55 are mounted in the pull rod. A positioning ring 561 is provided on the tail of the pull rod 56 and embedded in the positioning groove 571 on the slider 57. The limiting silencing ring 55 is clamped in the U-shaped groove 27 on the positioning plate.

The latch bolt assembly 5 is connected to the damper 7 through the connecting rod 6, the slider 57 is provided with a connecting rod pivot 572, the damper 7 is provided with a damping flat shaft 71, one end of the pull rod 6 is provided with a movable pivot hole 61 pivotally connected to the connecting rod pivot 572, and another end of the pull rod 6 is provided with an embedded flat groove 62 in which the damping flat shaft 71 is embedded.

Figure 3:
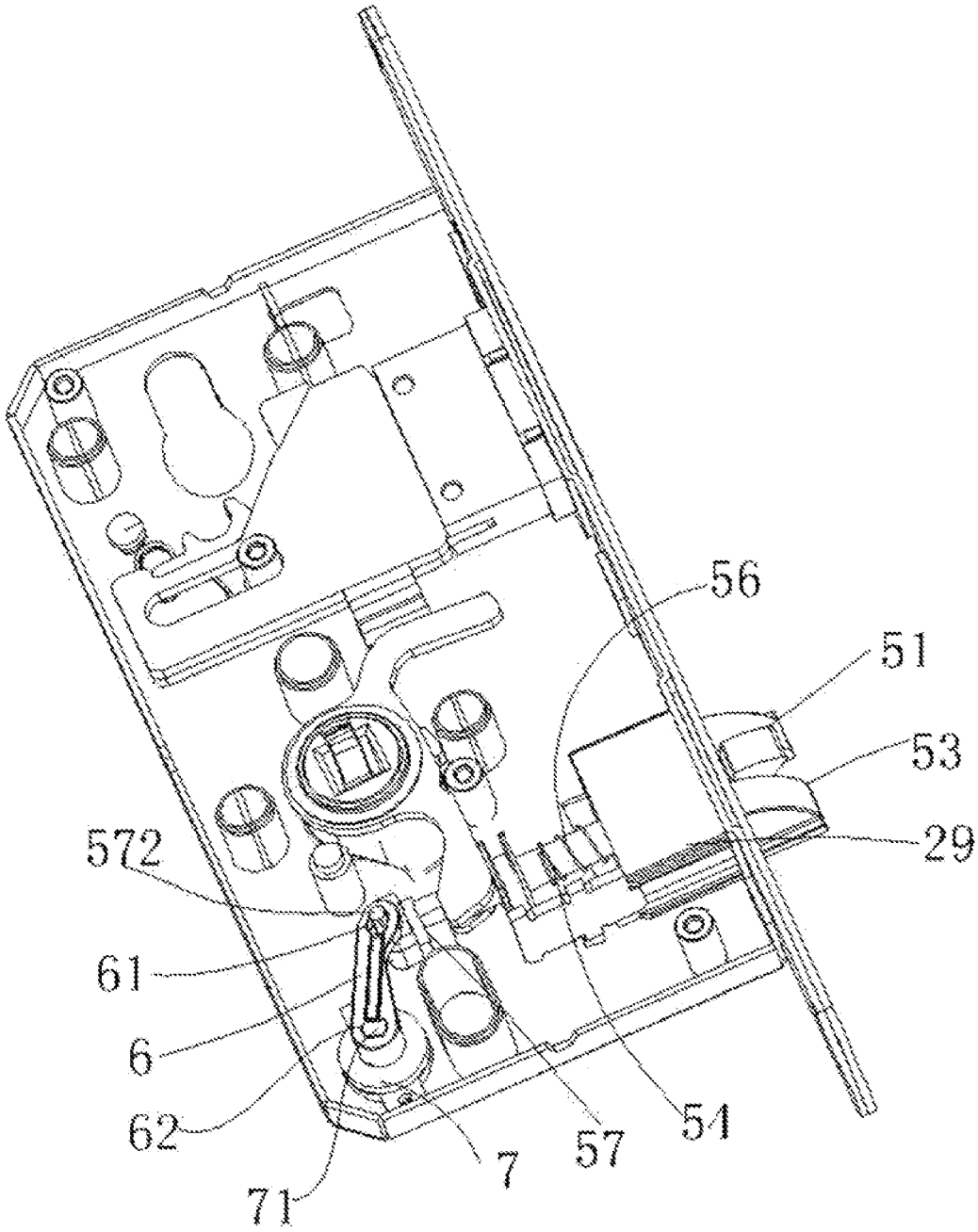
FIG. 3 is a schematic diagram illustrating the extension state of the latch bolt in the first embodiment of the present disclosure.
Figure 4:
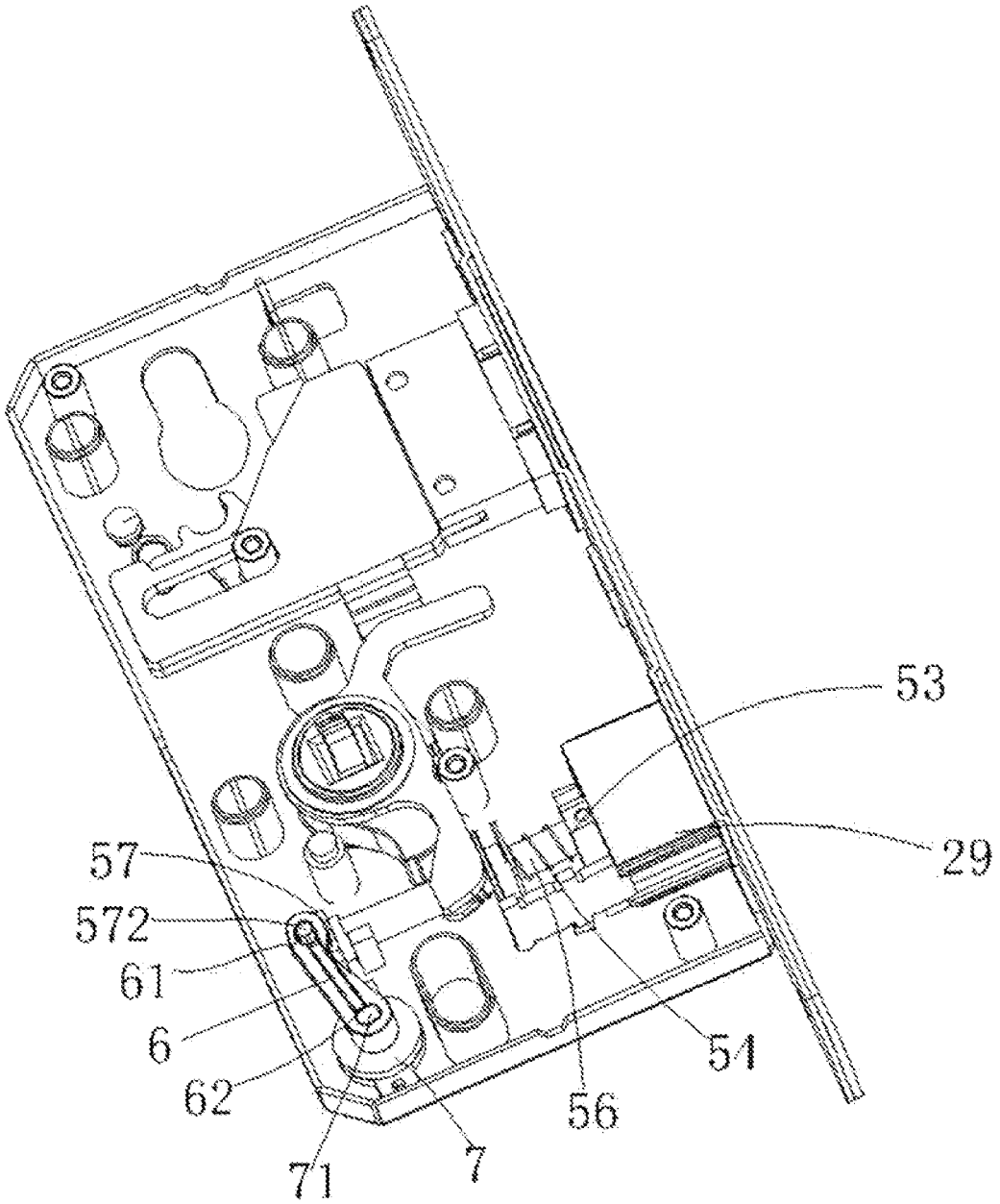
FIG. 4 is a schematic diagram illustrating the retraction state of the latch bolt in the first embodiment of the present disclosure.

As shown in FIG. 3 and FIG. 4, in the first embodiment of the present disclosure, the latch bolt 53 extends under the elastic force of the spring 54, the slider 57 slides together with the pull rod 56, the connecting rod pivot 572 slides in the movable pivot hole 61 and drives the end of the movable pivot hole 61 of the connecting rod 6 to swing, the connecting rod 6 transmits the swing moment to the damper 7 through the embedded flat groove 62 and the damper flat shaft 71, and the damper 7 generates rotational resistance to slow down the swing moment, therefore, the buffer for the extension of the latch bolt 53 can be achieved, so that the latch bolt 53 extends at a constant speed to reduce the impact. The latch bolt 53 retracts under the external force, the slider 57 slides together with the pull rod 56, the connecting rod pivot 572 slides in the movable pivot hole 61 and drives the end of the movable pivot hole 61 of the connecting rod 6 to swing, the connecting rod 6 transmits the swing moment to the damper 7 through the embedded flat groove 62 and the damper flat shaft 71, and the damper 7 generates rotational resistance to slow down the swing moment, therefore, the buffer for the retraction of the latch bolt 53 can be achieved, so that the latch bolt 53 retracts at a constant speed. During the extension and retraction of the latch bolt 53, the latch bolt 53 slides in the silencing block of the latch bolt 29, and no frictional sound is generated. The front end of the silencing block of the latch bolt 29 is provided with the positioning column, and after the latch bolt 53 extends, the friction bolt 51 is poked when abutting against the positioning column, and in the process, the friction bolt 51 collides with the silencing block of the latch bolt 29 without generating noise. Therefore, during the normal use of the door lock, the latch bolt of the door lock and each linkage do not generate noise due to collision with each other.

Figure 5:
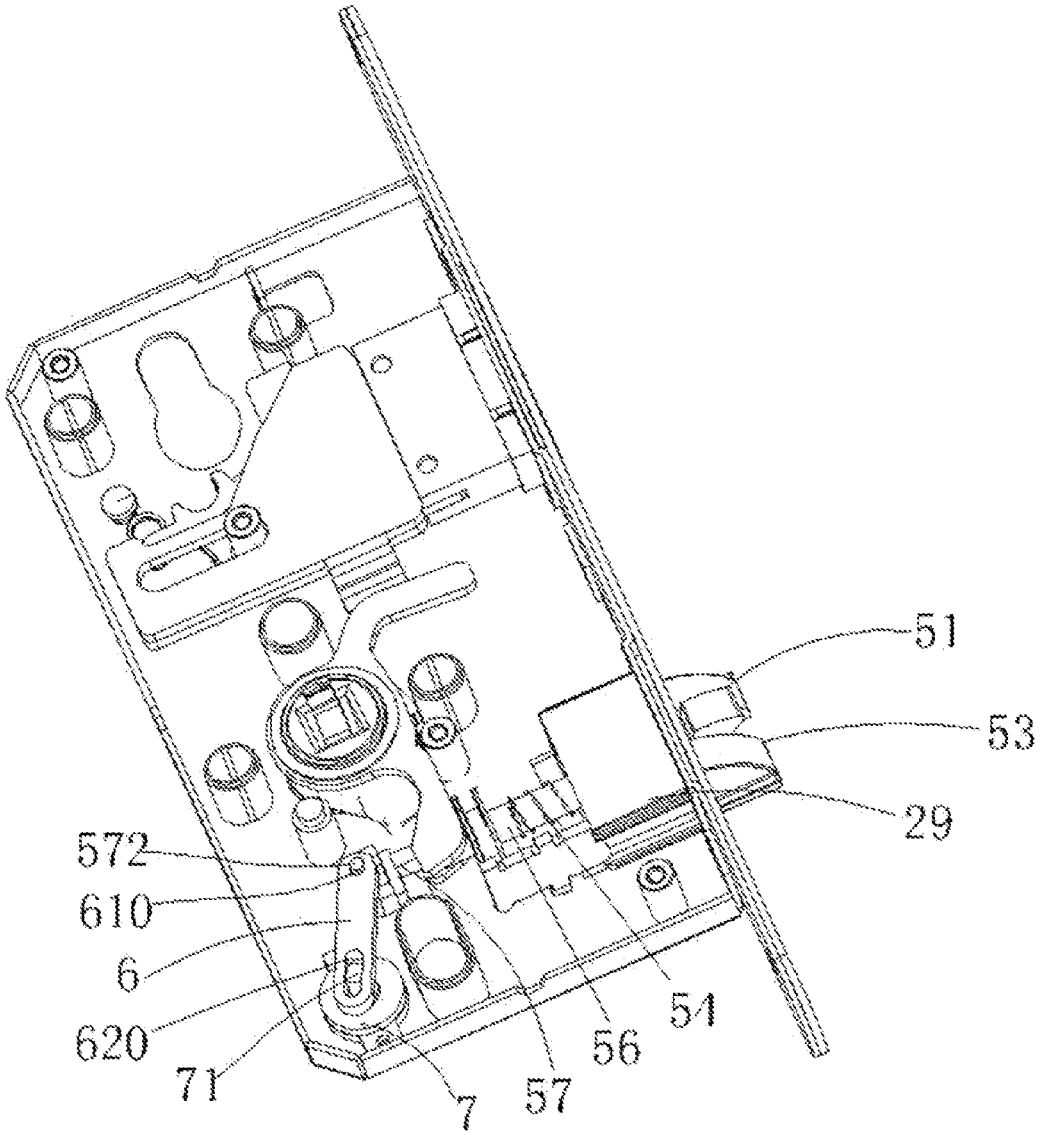
FIG. 5 is a schematic diagram illustrating the extension state of the latch bolt in the second embodiment of the present disclosure.
Figure 6:
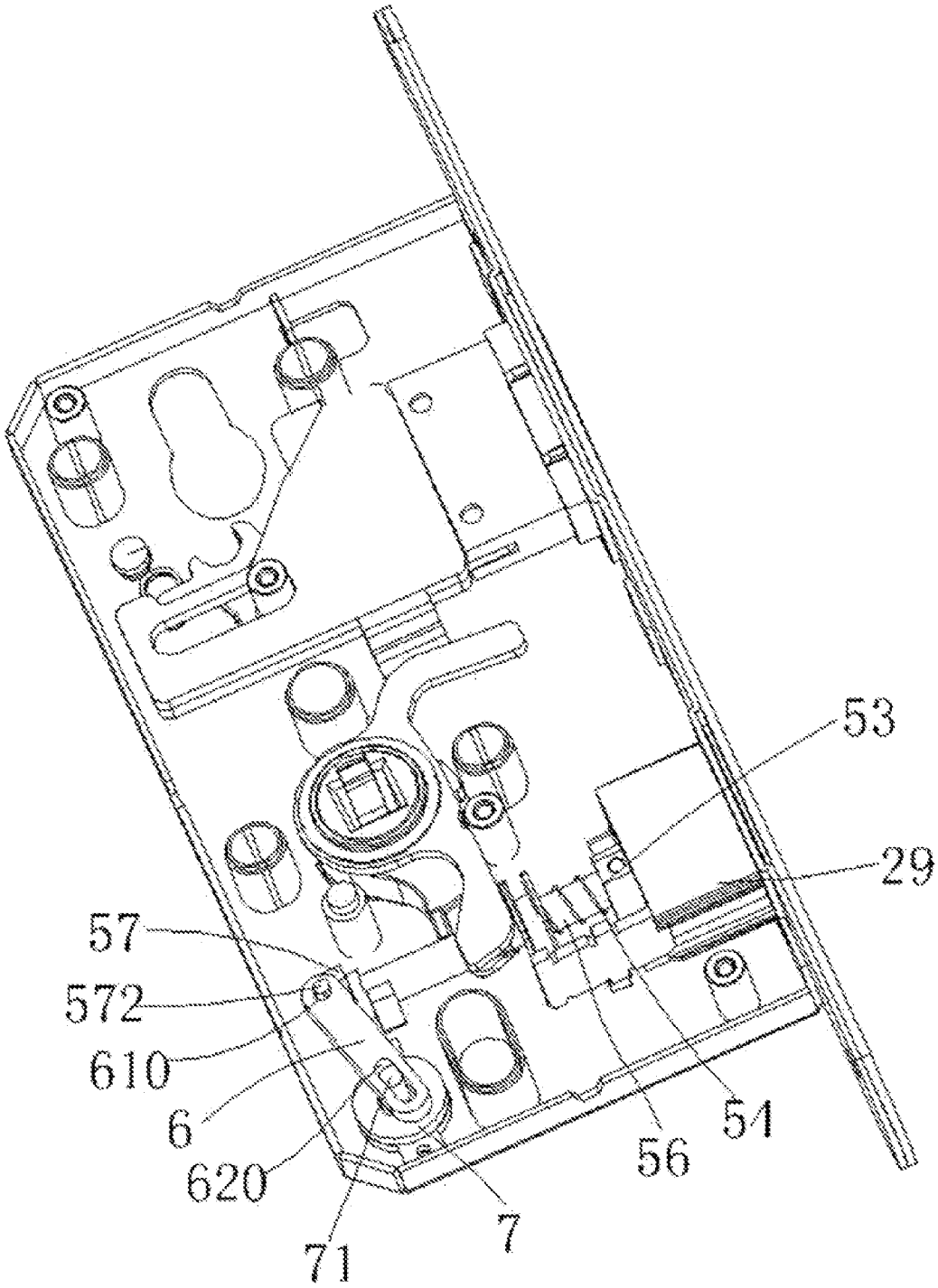
FIG. 6 is a schematic diagram illustrating the retraction state of the latch bolt in the second embodiment of the present disclosure.

As shown in FIG. 5 and FIG. 6, in the second embodiment of the present disclosure, the latch bolt 53 extends under the elastic force of the spring 54, the slider 57 slides together with the pull rod 56, the connecting rod pivot 572 rotates in the pivot hole 610 and drives the end of the pivot hole 610 of the connecting rod 6 to swing, the connecting rod 6 transmits the swing moment to the damper 7 through the sliding groove 620 and the damper flat shaft 71, and the damper 7 generates rotational resistance to slow down the swing moment, therefore, the buffer for the extension of the latch bolt 53 can be achieved, so that the latch bolt 53 extends at a constant speed to reduce the impact. The latch bolt 53 retracts under the external force, the slider 57 slides together with the pull rod 56, the connecting rod pivot 572 rotates in the pivot hole 610 and drives the end of the pivot hole 610 of the connecting rod 6 to swing, the connecting rod 6 transmits the swing moment to the damper 7 through the sliding groove 620 and the damper flat shaft 71, and the damper 7 generates rotational resistance to slow down the swing moment, therefore, the buffer for the retraction of the latch bolt 53 can be achieved, so that the latch bolt 53 retracts at a constant speed. During the extension and retraction of the latch bolt 53, the latch bolt 53 slides in the silencing block of the latch bolt 29, and no frictional sound is generated. The front end of the silencing block of the latch bolt 29 is provided with the positioning column, and after the latch bolt 53 extends, the friction bolt 51 is poked when abutting against the positioning column, and in the process, the friction bolt 51 collides with the silencing block of the latch bolt 29 without generating noise. Therefore, during the normal use of the door lock, the latch bolt of the door lock and each linkage do not generate noise caused by collision with each other.

What is claimed is:

1. A latch bolt buffer structure for a lock body, comprising an outer lining board for the lock body, a box cover for the lock body, a box bottom assembly for the lock body, a latch bolt assembly, a damper, a connecting rod, a dead bolt mechanism and a latch bolt poking mechanism, the box bottom assembly for the lock body being formed by welding a box bottom and an inner lining board for the lock body, a bottom plate surface of the box bottom being provided with a positioning plate, and the positioning plate being provided with a U-shaped groove, wherein:

the latch bolt assembly comprises a latch bolt, a friction bolt, a pull rod, a spring, a limiting silencing ring, and a slider, the middle of the latch bolt is provided with the friction bolt; the pull rod is fixed on a rear end of the latch bolt, the spring and the limiting silencing ring are mounted in the pull rod, and a positioning ring is provided on a tail of the pull rod and embedded in a positioning groove on the slider; the limiting silencing ring is clamped in the U-shaped groove on the positioning plate; and the latch bolt assembly is connected to the damper through the connecting rod, the slider is provided with a connecting rod pivot, the damper is provided with a damping flat shaft, one end of the connecting rod is provided with a movable pivot hole pivotally connected to the connecting rod pivot, and another end of the connecting rod is provided with an embedded flat groove in which the damping flat shaft is embedded; and when the latch bolt extends or retracts, the slider slides together with the pull rod, the connecting rod pivot slides in the movable pivot hole and drives an end of the connecting rod having the movable pivot hole to swing, the connecting rod transmits a swing moment to the damper through the embedded flat groove and the damper flat shaft, and the damper generates rotational resistance to slow down the swing moment.

2. The latch bolt buffer structure for the lock body of claim 1, wherein the latch bolt poking mechanism comprises a latch bolt poking member, a poking piece, an upper silencing pad, and a lower silencing pad.

3. A latch bolt buffer structure for a lock body, comprising an outer lining board for the lock body, a box cover for the lock body, a box bottom assembly for the lock body, a latch bolt assembly, a damper, a connecting rod, a dead bolt mechanism and a latch bolt poking mechanism, the box bottom assembly for the lock body being formed by welding a box bottom and an inner lining board for the lock body, a bottom plate surface of the box bottom being provided with a positioning plate, and the positioning plate being provided with a U-shaped groove, wherein: the latch bolt assembly comprises a latch bolt, a friction bolt, a pull rod, a spring, a limiting silencing ring, and a slider, the middle of the latch bolt is provided with the friction bolt; the pull rod is fixed on a rear end of the latch bolt, the spring and the limiting silencing ring are mounted in the pull rod, and a positioning ring is provided on a tail of the pull rod and embedded in a positioning groove on the slider; the limiting silencing ring is clamped in the U-shaped groove on the positioning plate; and the latch bolt assembly is connected to the damper through the connecting rod, the slider is provided with a connecting rod pivot, the damper is provided with a damping flat shaft, one end of the connecting rod is provided with a pivot hole pivotally connected to the connecting rod pivot, and another end of the connecting rod is provided with a sliding groove in which the damping flat shaft is embedded, the damping flat shaft is slidable in the sliding groove; and when the latch bolt extends or retracts, the slider slides together with the pull rod, and at the same time drives the end of the pivot hole of the connecting rod to swing, the connecting rod transmits the swing moment to the damper through the sliding groove and the damper flat shaft, and the damper generates rotational resistance to slow down the swing moment.

* * * * *